US010843857B2

(12) United States Patent
Matthews et al.

(10) Patent No.: US 10,843,857 B2
(45) Date of Patent: Nov. 24, 2020

(54) PACKAGING CONTAINER FOR CAR FLOOR MATS

(71) Applicant: Custom Accessories Inc., Richmond, IL (US)

(72) Inventors: Giles Frederick Matthews, Hawthorn (AU); Nathanael Andrew Hunt, Eltham (AU); Warwick James Brown, North Melbourne (AU)

(73) Assignee: Custom Accessories Inc., Richmond, IL (US)

( * ) Notice: Subject to any disclaimer, the term of this patent is extended or adjusted under 35 U.S.C. 154(b) by 313 days.

(21) Appl. No.: 14/512,843

(22) Filed: Oct. 13, 2014

(65) Prior Publication Data

US 2016/0023840 A1 Jan. 28, 2016

(30) Foreign Application Priority Data

Jul. 22, 2014 (AU) ..... 2014902827

(51) Int. Cl.
*B65D 73/00* (2006.01)

(52) U.S. Cl.
CPC ..... *B65D 73/0064* (2013.01); *B65D 73/0007* (2013.01); *B65D 2585/6882* (2013.01)

(58) Field of Classification Search
CPC .... B65D 81/36; B65D 33/14; B65D 73/0064; Y10T 24/45257; A47F 7/16
USPC ..... 206/477, 495, 335, 806
See application file for complete search history.

(56) References Cited

U.S. PATENT DOCUMENTS 5,075,938 A 12/1991 Hutchinson
5,199,139 A * 4/1993 Hutchinson ..... A44B 17/0029 24/108
5,257,694 A * 11/1993 Wallach ..... A47G 25/485 206/284

(Continued)

FOREIGN PATENT DOCUMENTS

CA 2816200 A1 7/2014
TW 375893 U 12/1999

OTHER PUBLICATIONS

Chinese Patent Office; Office Action in related Chinese Patent Application No. 201510427590.0 dated Nov. 30, 2017; 13 pages.

*Primary Examiner* — Anthony D Stashick
*Assistant Examiner* — Blaine G Neway
(74) *Attorney, Agent, or Firm* — Leydig, Voit & Mayer, Ltd.

(57) ABSTRACT

A packaging container for a car floor mat including: a main body; at least one post member extending from the main body for supporting the car floor mat, and a securing arrangement releasably secured to the post member, the car floor mat being retained on the post member when the securing arrangement is secured to the post member, the car floor mat being removable from the packaging container when the securing arrangement is released from the post member, wherein the securing arrangement includes a catch supported on the main body by a hinged connection, the catch including a ring member for encircling the post member when engaging the post member, the ring member having an inwardly directed engagement member for engaging an overbite provided on the post member when the catch is hinged towards and interlocks with the post member.

9 Claims, 3 Drawing Sheets

(56) References Cited

U.S. PATENT DOCUMENTS

| | | | | |
|---|---|---|---|---|
| 6,330,736 | B1 * | 12/2001 | Cheng | A44B 11/258 24/656 |
| 6,584,656 | B1 * | 7/2003 | Karmeli | A44C 7/003 24/601.5 |
| 7,389,885 | B2 * | 6/2008 | Masanek, Jr. | A47F 5/0006 211/113 |
| 9,004,276 | B2 * | 4/2015 | Brown | B65D 85/54 206/335 |
| 9,301,625 | B2 * | 4/2016 | Fiumefreddo | A47F 7/16 |
| 2013/0340259 | A1 * | 12/2013 | Huang | A47F 5/0006 30/123 |
| 2014/0203015 | A1 * | 7/2014 | Brown | B65D 73/0021 220/4.22 |

* cited by examiner

PACKAGING CONTAINER FOR CAR FLOOR MATS

FIELD OF THE INVENTION

The present invention is generally directed to packaging for retail products, and in particular to a packaging container for goods hung for display. While the present invention will be described with respect to its application for packaging car floor mats, it is to be appreciated that the invention is not limited to this application, and that other applications are also envisaged.

BACKGROUND OF THE INVENTION

Car floor mats are typically hung up for display in retail outlets selling such products. The packaging for such car floor mats generally comprises a cardboard sheet which is folded in the middle to provide two leaves between which can be located end portions of each car floor mat in a sandwich arrangement. Securing means such as staples are used to secure and retain the car floor mats between the cardboard leaves. The cardboard sheet may also be cut to form a hook, or a separate hook may be secured to the cardboard sheet to allow hanging of the products.

A problem with such packaging is that it is difficult or not possible to repack the car floor mats once they have been separated from the packaging. Therefore, if the car floor mats are for any reason returned to the shop, it is difficult or not possible to reuse the packaging to resell the product. This may be due to not having the means to resecure the car floor mats again to the packaging or due to damage to the packaging when the car floor mats were initially separated from the packaging. Even if the shop attempts to repackage the car floor mats, the resultant repacked product may be unattractive. This can have the effect of customers not being prepared to purchase such repackaged products.

The Applicant has developed packaging containers suitable for car floor mats which address the above described problems. These packaging containers are described in the Applicant's U.S. patent application Ser. Nos. 13/770,257 and 13/893,603, details of which are incorporated herein by reference. The packaging containers can be made from durable material such as plastic, and can utilise a releasable securing arrangement for securing the car floor mats to the container that can be resecured if opened. This arrangement allows for easy repackaging of the car floor mats if they are removed from the container by customers. The main body and the securing arrangement for these packaging containers are however made from separate parts that need to be produced separately and subsequently assembled together prior to use. Therefore, the cost for producing these containers is relatively high when compared with the cost of conventional cardboard packaging.

It would therefore be advantageous to provide a packaging container for car floor mats that addresses one or more of the above described problems of prior art packaging.

SUMMARY OF THE INVENTION

According to the present invention, there is provided a packaging container for a car floor mat including: a main body; at least one post member extending from the main body for supporting the car floor mat, and a securing arrangement releasably secured to the post member, the car floor mat being supported and retained on the post member when the securing arrangement is secured to the support member; wherein the securing arrangement includes a catch supported on the main body by a hinged connection, the catch including a ring member for encircling the post member when engaging the post member, the ring member having an inwardly directed engagement member for engaging an overbite provided on the post member when the catch is hinged towards and interlocks with the post member.

The engagement member may be in the form of a tooth extending inwardly within the ring member. The tooth may be located within the ring member at an outermost position relative to the hinged connection. Therefore, the tooth may be displaced away from the location of the hinged connection by deformation of the ring member into an elongate shape having an elongate axis extending though the hinged connection and the tooth respectively. The ring member may be deformed in the way by applying a squeezing force on opposing sides of the ring member lateral to the elongate axis. Finger rests may be provided on opposing outer surfaces of the ring member away from the tooth to facilitate squeezing of the ring member such that the ring member is deformed to the elongate shape to thereby displace the tooth away from the overbite. This therefore allows the clasp to be released from the interlocking engagement with the post member by displacing the engagement member away from the overbite in the post member.

The post member may include a tapered surface at a free end of the post member for engaging the ring member when the clasp initially comes into contact with the post member. This arrangement acts to stretch the ring member into an elongate shape as it is displaced over the post member so that the tooth can be displaced over the tapered surface until the tooth comes into contact with and engages the overbite of the post member. The ring member may then substantially assume its original shape after engagement of the tooth with the overbite. The overbite may be located at the free end of the post member, and preferably immediately adjacent the tapered surface such that the ring member of the clasp may lay substantially parallel to the main body when engaging the post member.

The catch may further include an inwardly extending abutment tongue located within the ring member immediately opposite the tooth for abutting the post member when the catch is engaged with the post member. The post member may have a generally circular lateral cross-section, and the abutment member may include a concave shaped end for abutting an outer surface of the post member. The abutment member helps to ensure that the catch remains engaged to the post member, the abutment member preventing or minimising movement of the tooth away from the overbite when a force is for example applied by the weight of the supported car floor mat on the catch. The catch may therefore not be disengaged unless a squeezing force is applied to the ring member. The tooth may also be provided with a concave shaped free end to facilitate movement of the tooth over the tapered surface to the overbite of the post member.

The catch may preferably be integrally formed together with the main body. Therefore, the hinged connection may provide an integral connection between the main body and the clasp. Having the catch integrally formed with the main body helps to reduce the manufacturing costs as it is no longer necessary to produce and assemble together up to four separate components used in the Applicants' earlier packaging container design.

Preferably two or more said post members may be provided on the main body, with separate securing arrangements provided for each post member. The main body may include an integral hook portion for hanging the packaging container. A planar extension may preferably be provided for the main body for providing a support surface thereon. The planar extension may be secured to the main body by using plastic welding or other securing techniques. It is also envisaged that the planar extension is integrally formed together with the main body. This provides an area on the packaging container for supporting advertising and branding information.

The car floor mats may include one or more apertures which enable the car floor mat to be passed over the post member(s) and retained in position by the securing arrangement(s). The car floor mat may be moulded in rubber or similar material with an integral tab moulded on an edge of the floor mat. One or more apertures may be provided in the tab. It is also envisaged that a separate means may be provided to secure mats that do not have any apertures within the mat to be supported on the support member. For example, a tab member may be secured to the floor mat using staples, adhesive or other securing means, with an aperture being provided through the tab member to allow the support member to pass therethrough.

The floor mats can be removed from the packaging assembly by releasing the securing arrangement(s). The car floor mats can then be removed from the support members. The packaging container can however be reused by replacing the car floor mats on the post members and resecuring the securing arrangement to the support member.

The packaging container may be formed from a material having stronger material properties than cardboard. Preferably, each body portion can be injection moulded from plastic material such as polypropylene or ABS. The use of other materials is also envisaged.

The packaging container according to the present invention can be readily reused, even after the products have been removed from the packaging. This therefore facilitates repackaging of the products if required. The construction of the packaging container also potentially reduces any damage to the packaging following opening thereof. The packaging container can also be used to support the car floor mat when it needs to be washed, for example, when being hosed down with water. This provides an additional use for the packaging container after purchase of the product.

BRIEF DESCRIPTION OF THE DRAWINGS

It will be convenient to further describe the invention with reference to the accompanying drawings which illustrate preferred embodiments of the present invention. Other embodiments are possible, and consequently, the particularity of the accompanying drawings is not to be understood as superseding the generality of the preceding description of the invention.

In the drawings.

DETAILED DESCRIPTION OF THE INVENTION

Figure 1:
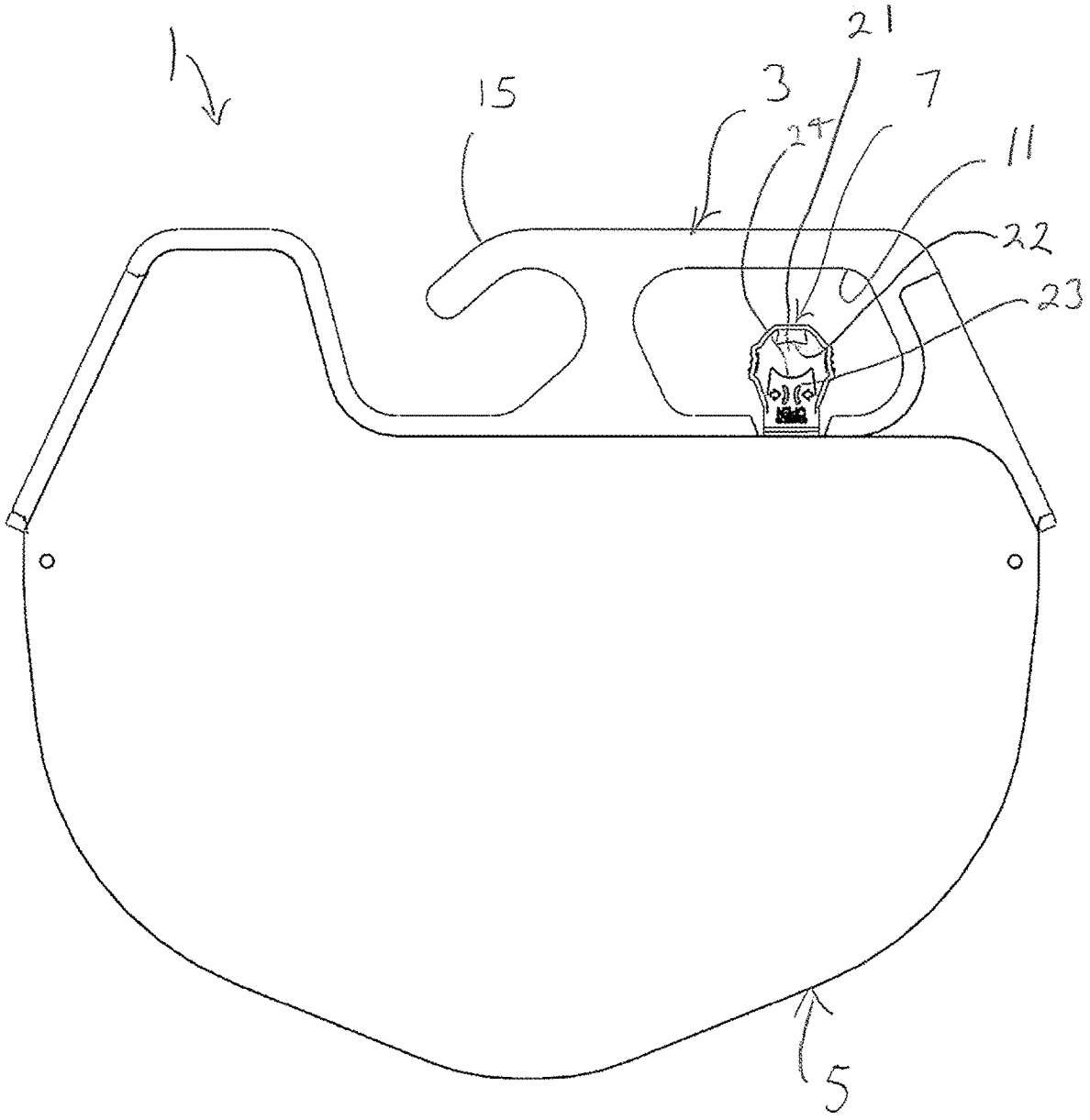
FIG. 1 is a front view of a packaging container according to the present invention.

The packaging container 1 according to the present invention includes a main body 3 which is formed together with an integral hanging hook 15 for hanging the container 1, and an integral hand opening 11 to allow the container 1 together with the car floors mats (not shown) retained by the container 1 to be carried. A planar extension 5 is also secured to the main body 3 to provide an area for supporting advertising and branding information on the container 1.

Figure 2:
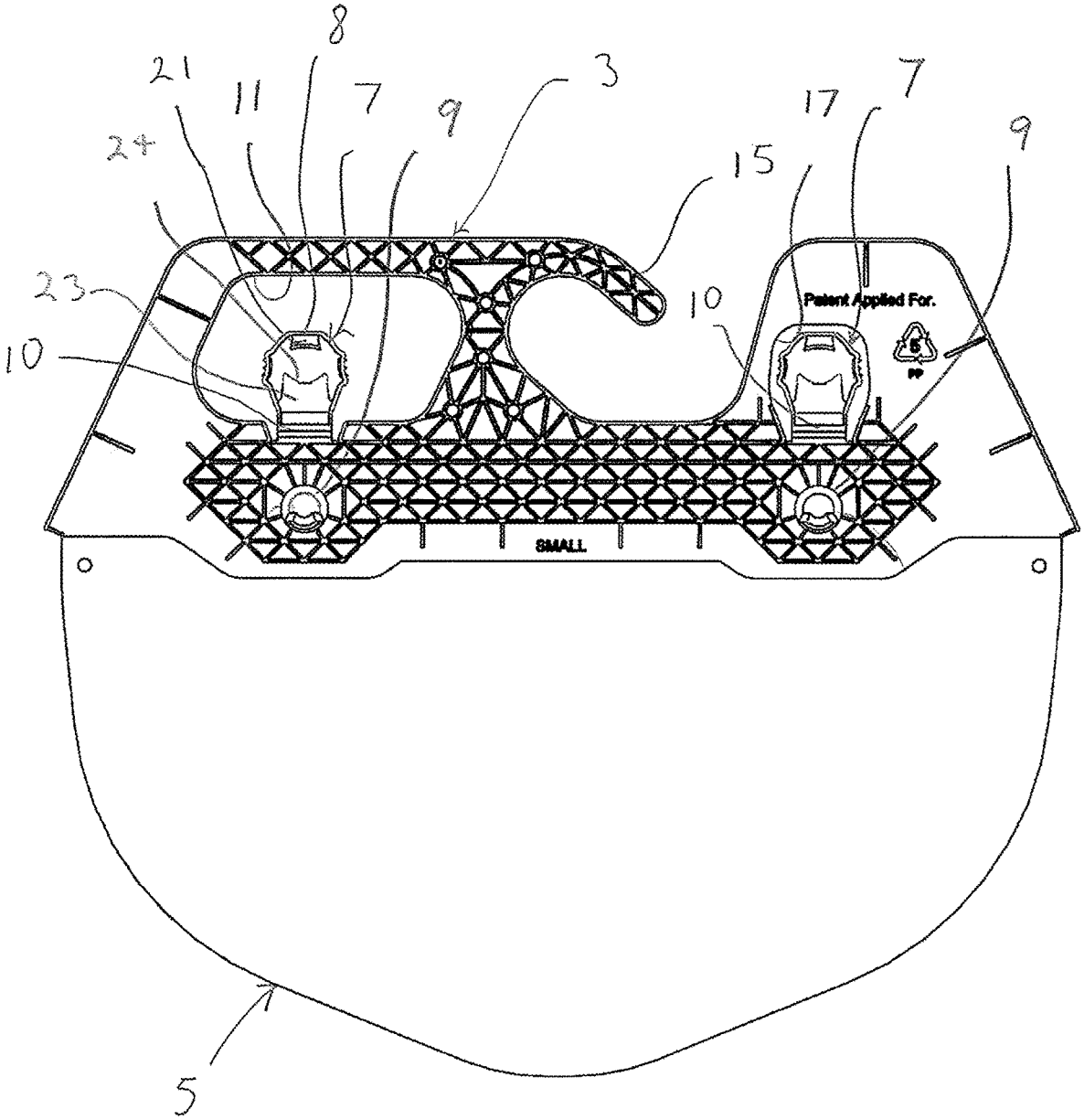
FIG. 2 is a rear view of the packaging container of FIG. 1.
Figure 3:
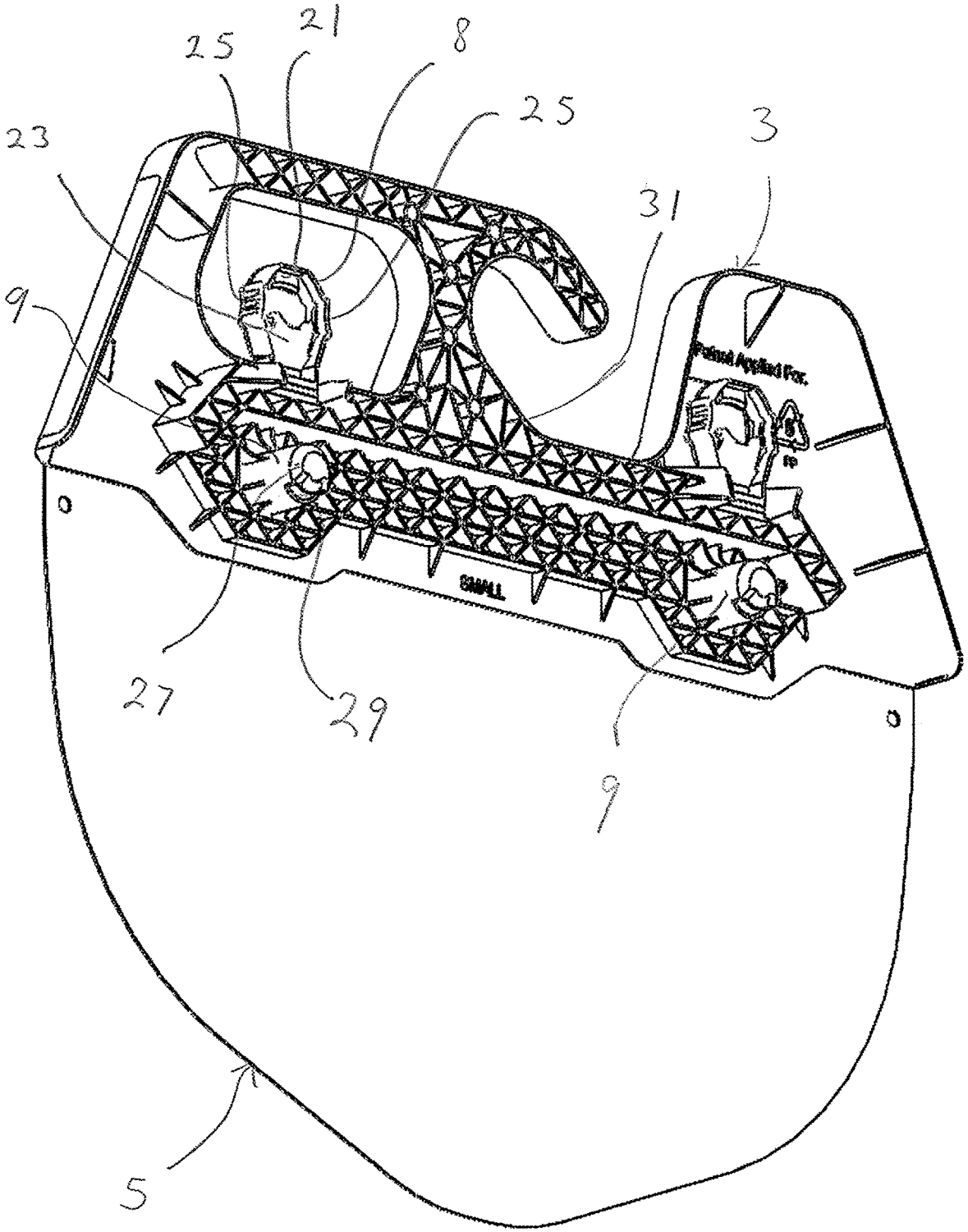
FIG. 3 is a perspective rear view of the packaging container of FIG. 1.

The main body 3 further includes two post members 9 extending laterally from the rear of the main body 9 as best shown in FIGS. 2 and 3. Each post member 9 is circular in cross-section and has a tapered surface 27 located at the peripheral end of each post member 9. An overbite 29 in the form of a slot opening is located immediately adjacent the post member tapered surface 27.

Two catches 7 are respectively secured by a hinge connection 10 to the main body 3. The two catches 7 and the two post members 9 can be integrally formed together as part of the main body 3. The main body 3 is injection moulded in plastic such as polypropylene which provides the necessary strength and resilience to form the integral hinge connections and enable the catches 7 to cooperate with the post members 9 and provide the interlocking arrangement for retaining car floor mats on the container 1. Reinforcement webbing 31 is also formed as part of the rear face of the main body 3 to provide structural strength to the main body 3. The manufacturing costs can therefore be minimised by integrally forming the main body 3 together with the catches 7 as a single component.

The operation of the securing arrangement will now be described in detail. Each catch 7 includes a ring member 8 which is secured to the main body 3 via the hinged connection 10. Each ring member 8 has an inwardly directed engagement member 21 in the form of a tooth is located at an outermost position relative to the hinged connection 10 within the ring member 8. This positioning allows the tooth 21 to be displaced away from the location of the hinged connection 10 if the ring member 8 is deformed into a slightly elongate shape by applying a squeezing force on opposing sides of the ring member 8 lateral to an elongate axis extending through the hinged connection 10 and the tooth 21. The tooth 21 has a concave shaped peripheral end 22 having a radius substantially corresponding to the diameter of the post member 9 where the overbite 29 is located. The concave shaped free end 22 of the tooth 21 is adapted to facilitate engagement with the overbite 29 provided on the post member 9.

Two finger rests 25 are provided between the tooth and 21 and the abutment tongue 23 on opposing sides of the outer surfaces of the ring member 8 to facilitate squeezing of the ring member 8 to thereby release the catch 7 from the post member 9. An inwardly extending abutment tongue 23 is also provided within the ring member 8 and is located opposite to the tooth 21. The abutment tongue 23 has a concaved shaped free end 24 having a radius substantially corresponding to the diameter of the post member 9 to thereby closely abut the curved outer surface of the post member 9.

When the catch 7 is hinged towards the post member 9, the ring member 8 initially contacts the tapered surface 27 of the post member 9. The contact between the ring member 8 and the tapered surface 27 acts to stretch the ring member 8 over the tapered surface 27 to thereby displace the tooth 21 over the tapered surface 27 and away from the post member 9. The continued hinged movement of the catch 7 then causes the tooth 21 to engage the overbite 29 on the post member 9 to thereby interlock the catch 9 to the post member 9. The concave shaped free end 24 of the abutment tongue 23 abuts against the outer surface of the post member 9 to thereby prevent displacement of the ring member 8 when interlocked with the post member 9, and therefore displacement of the tooth 21 away from the overbite 29 if any force from, for example, the weight of the car floor mats is applied against the catch 7.

The catch 7 can be subsequently released from its engagement with the post member 9 by applying a squeezing force on the ring member 8 at the provided opposing finger rests 25. This deforms the ring member 8 to an elongate shape that displaces the tooth 21 out from the overbite 29 thereby releasing the clasp 7 from the post member 9.

Car floor mats can be provided with apertures that allow the post members 9 of the container 1 to be passed though these apertures, with the catches 8 being subsequently secured to thereby allow car floor mats to be retained on the packing container 1 according to the present invention. The catches 8 can also be easily released and resecured thereby facilitating repacking of the car floor mats if removed from the containers 1.

The packaging container 1 according to the present invention therefore allows for straightforward repackaging of products such as car floor mats as well as being durable enough to be reused without damage to the packaging container 1.

Modification and variations as would be deemed obvious to the person skilled in the art are included within the ambit of the present invention as claimed in the appended claims.

The claims defining the invention are as follows:

1. A packaging container for a car floor mat including:

a main body;

at least one post member extending from the main body for supporting the car floor mat;

a securing arrangement releasably secured to the post member, the car floor mat being supported and retained on the post member when the securing arrangement is secured to the post member;

wherein the securing arrangement includes a catch integrally formed together with and supported on the main body by a hinged connection, the catch including a ring member for encircling the post member when engaging the post member, the ring member having an inwardly directed engagement member for engaging an overbite provided on the post member when the catch is hinged towards and interlocks with the post member, wherein the engagement member includes a tooth extending inwardly within the ring member and located at an outermost position relative to the hinged connection, and wherein the tooth is displaceable away from the location of the hinged connection by deformation of the ring member into an elongate shape having an elongate axis extending though the hinged connection and the tooth respectively; and first and second discrete finger rests positioned on diametrically opposed sides of the ring member and arranged on opposite sides of the tooth.

2. A packaging container according to claim 1, wherein the post member includes a tapered surface at a free end of the post member for engaging the ring member when the catch initially comes into contact with the post member, and wherein the overbite is located at the free end of the post member immediately adjacent the tapered surface.

3. A packaging container for a car floor mat, comprising:

a main body;

at least one post member extending from the main body for supporting the car floor mat;

a securing arrangement releasably secured to the post member, the car floor mat being supported and retained on the post member when the securing arrangement is secured to the post member;

wherein the securing arrangement includes a catch integrally formed together with and supported on the main body by a hinged connection, the catch including a ring member for encircling the post member when engaging the post member, the ring member having an inwardly directed engagement member for engaging an overbite provided on the post member when the catch is hinged towards and interlocks with the post member, wherein the engagement member includes a tooth extending inwardly within the ring member and located at an outermost position relative to the hinged connection, and wherein the tooth is displaceable away from the location of the hinged connection by deformation of the ring member into an elongate shape having an elongate axis extending though the hinged connection and the tooth respectively;

wherein the catch further includes an inwardly extending abutment tongue located within the ring member immediately opposite the tooth, the abutment tongue abutting an outer surface of the post member when the catch is engaged with the post member; and first and second discrete finger rests positioned on diametrically opposed sides of the ring member and disposed between the tooth and the abutment tongue.

4. A packaging container according to claim 1, wherein two or more said post members are provided on the main body, and two or more respective catches are provided on the main body.

5. A packaging container according to claim 1, wherein the main body includes an integral hook portion for hanging the packaging assembly.

6. A packaging container according to claim 1, further including a planar extension secured to the main body for providing a support surface thereon.

7. A packaging container according to claim 1, further including one or more car floor mats supported therein.

8. A packaging container according to claim 1, wherein the tooth comprises a concave-shaped peripheral end having a radius corresponding to an outer diameter of the post member.

9. A packaging container according to claim 3, wherein the abutment tongue comprises a concave-shaped free end having a radius corresponding to an outer diameter of the post member.

* * * * *